US010648701B2

(12) United States Patent
Chhajed

(10) Patent No.: US 10,648,701 B2
(45) Date of Patent: May 12, 2020

(54) REFRIGERATION SYSTEMS AND METHODS USING WATER-COOLED CONDENSER AND ADDITIONAL WATER COOLING

(71) Applicant: Thermo Fisher Scientific (Asheville) LLC, Asheville, NC (US)

(72) Inventor: Rahul Chhajed, Asheville, NC (US)

(73) Assignee: Thermo Fisher Scientific (Asheville) LLC, Asheville, NC (US)

( * ) Notice: Subject to any disclaimer, the term of this patent is extended or adjusted under 35 U.S.C. 154(b) by 37 days.

(21) Appl. No.: 15/889,681

(22) Filed: Feb. 6, 2018

(65) Prior Publication Data

US 2019/0242623 A1 Aug. 8, 2019

(51) Int. Cl.

| | |
|---|---|
| ***F25B 7/00*** | (2006.01) |
| ***F25B 39/00*** | (2006.01) |
| ***F25D 11/04*** | (2006.01) |
| ***F25B 39/04*** | (2006.01) |

(52) U.S. Cl.

CPC ..... *F25B 7/00* (2013.01); *F25B 39/00* (2013.01); *F25D 11/04* (2013.01); *F25B 39/04* (2013.01); *F25B 2339/047* (2013.01)

(58) Field of Classification Search

CPC ..... F25B 7/00; F25B 2339/047; F25B 39/00; F25B 39/04; F24F 2140/12; F25D 11/04

USPC ..... 165/285

See application file for complete search history.

(56) References Cited

U.S. PATENT DOCUMENTS

| | | | | |
|---|---|---|---|---|
| 3,421,574 | A * | 1/1969 | Kals | F17C 9/02 165/285 |
| 3,590,595 | A | 7/1971 | Briggs | |
| 4,000,626 | A | 1/1977 | Webber | |
| 5,687,579 | A | 11/1997 | Vaynberg | |
| 5,689,966 | A | 11/1997 | Zess et al. | |
| 5,946,932 | A | 9/1999 | Wang | |
| 7,644,593 | B2 | 1/2010 | Duraisamy | |
| 7,749,360 | B2 | 7/2010 | Waldron | |
| 8,141,381 | B2 | 3/2012 | Ino et al. | |
| 8,291,723 | B1 | 10/2012 | Backman | |
| 8,408,022 | B2 | 4/2013 | Stockton, Jr. | |
| 8,429,931 | B2 | 4/2013 | Ikegami et al. | |
| 8,752,616 | B2 | 6/2014 | Kroliczek et al. | |
| 8,763,417 | B2 | 7/2014 | Szutu | |

(Continued)

*Primary Examiner* — Jon T. Schermerhorn, Jr.

(74) *Attorney, Agent, or Firm* — Wood Herron & Evans LLP

(57) ABSTRACT

A refrigerator of the present invention includes a refrigeration system having a water-cooled condenser and a liquid line heat exchanger for additional cooling with the water, at a position upstream in the direction of flow of water from the cooling that occurs at the condenser. The use of water cooling at these two portions of the refrigeration system improves the energy efficiency of the refrigerator, while also significantly improving temperature responsiveness (e.g., reducing an amount of time necessary to "pull down" the temperature of a cooled space in the refrigerator to a desired set point temperature). The refrigerator may include one or a plurality of refrigeration stages, in various embodiments, and an additional sub-cooling heat exchanger may be provided in the refrigeration system downstream from the liquid line heat exchanger when the refrigerator includes multiple cascaded circuits.

10 Claims, 5 Drawing Sheets

(56) References Cited

U.S. PATENT DOCUMENTS

| | | | | |
|---|---|---|---|---|
| 8,844,308 | B2 | 9/2014 | Martin et al. | |
| 8,875,528 | B2 | 11/2014 | Immink et al. | |
| 8,974,688 | B2 | 3/2015 | Yana Motta et al. | |
| 9,151,521 | B2 | 10/2015 | Bittner | |
| 9,212,834 | B2 | 12/2015 | Parsonnet et al. | |
| 9,234,685 | B2 | 1/2016 | Koppineedi | |
| 9,242,532 | B2 | 1/2016 | Kim et al. | |
| 9,404,679 | B2 | 8/2016 | Ito et al. | |
| 9,435,553 | B2 | 9/2016 | Quisenberry | |
| 9,482,443 | B1 | 11/2016 | Backman | |
| 9,599,395 | B2 | 3/2017 | Yamashita et al. | |
| 9,664,424 | B2 | 5/2017 | Hinde et al. | |
| 2009/0188270 | A1 | 7/2009 | Takahashi et al. | |
| 2010/0242534 | A1 | 9/2010 | Stockton, Jr. | |
| 2011/0302936 | A1* | 12/2011 | Wang | F25B 7/00 62/79 |
| 2012/0204596 | A1* | 8/2012 | Takenaka | F25B 6/04 62/510 |
| 2012/0291478 | A1 | 11/2012 | Kim et al. | |
| 2013/0160449 | A1 | 6/2013 | Cogswell et al. | |
| 2013/0305756 | A1* | 11/2013 | Gomes | F25D 11/02 62/126 |
| 2015/0211810 | A1 | 7/2015 | Meguriya | |
| 2015/0345877 | A1 | 12/2015 | Mori et al. | |
| 2016/0010534 | A1 | 1/2016 | Kawakami et al. | |
| 2016/0265814 | A1 | 9/2016 | Pfister | |

* cited by examiner

REFRIGERATION SYSTEMS AND METHODS USING WATER-COOLED CONDENSER AND ADDITIONAL WATER COOLING

TECHNICAL FIELD

The present invention relates generally to refrigerators such as high performance commercial refrigerators/freezers and, more particularly, to refrigeration systems and methods using water cooling for at least part of the heat rejection from the refrigeration system.

BACKGROUND

Refrigeration systems are known for use with laboratory refrigerators and freezers of the type known as "high performance refrigerators" (the "high performance" label typically depending on specific limitations of peak temperature variation allowed within the refrigerator), which are used to cool their interior storage spaces to relative low temperatures such as about +4° C., about −30° C., or lower, for example. Refrigeration systems may include a single refrigerant stage circulating a refrigerant between a series of elements to remove heat energy from the interior storage spaces.

Refrigerators and freezers having two-stage cascade refrigeration systems are also known for cooling spaces such as the interior of cabinets, for example, to temperatures well below zero degrees Celsius, such as temperatures below −40° C. For example, freezers of the type known as ultra-low temperature ("ULT") freezers are known to use this type of refrigeration system and are used to cool cabinet interiors to temperatures as low as about −80° C. or even lower. Refrigeration systems of this type are known to include two refrigeration stages circulating first and second refrigerants, respectively. The first refrigeration stage transfers energy (i.e., heat) from the first refrigerant to the surrounding environment through a condenser, while the second refrigerant of the second refrigeration stage receives energy from the cooled space (e.g., a cabinet interior) through an evaporator. Heat is transferred from the second refrigerant to the first refrigerant through a heat exchanger that is in thermal fluid communication with the two refrigeration stages of the refrigeration system. To this end, the first and second refrigeration stages collectively operate to remove a significant amount of heat energy from the cooled space, to thereby achieve the low set point temperatures described above.

As will be readily understood, the removal of a high amount of heat energy from a cabinet interior (or similar cooled space) often necessitates a lengthy pull down time upon initial cooling of the cabinet interior from ambient temperature, or after a door opening event that adds ambient heat energy back into the cabinet interior. This is true in single stage refrigeration systems as well as in the cascade refrigeration systems of ULT freezers described above. As such, it is desirable to improve the energy efficiency and responsiveness of refrigeration systems to minimize an amount of time the cabinet interior remains at elevated temperatures above the desired set point temperature during operation.

Condensers used with conventional refrigeration systems of these types can be configured to discharge heat energy to air, water, or some other medium representing the ambient environment. Water-cooled condensers are known from several prior art references, including U.S. Pat. No. 5,689,966 to Zess et al.; U.S. Pat. No. 9,404,679 to Ito et al.; and U.S. Patent Publication No. 2012/0291478 to Kim et al., for example. These prior art references have achieved improvements in the efficiency of heat discharge at the condensers by transferring the heat energy to water flowing in a separate cooling circuit. However, further improvements in efficiency and temperature responsiveness beyond just water cooling in a condenser remain desirable in this field.

To this end, of the known examples of water-cooled condensers including those Patents identified above, only the Zess Patent (U.S. Pat. No. 5,689,966) describes that the water used to remove heat energy at the condenser may also be used in another heat exchanger. To this end, the water in FIG. 4 of the Zess Patent is used as a further heat discharge downstream from the condenser to receive heat energy stemming from a de-superheater heat exchanger and via another intermediate coolant circuit extending between the water circuit and the de-superheater heat exchanger in that refrigeration system. However, water used for such additional step(s) of heat discharge at the specified temperatures becomes subject to calcium carbonate deposits, which can then build up in the water circuit and diminish heat transfer performance/efficiency. Therefore, this type of arrangement has not been adopted as an effective solution for providing long-term improved efficiency and temperature responsiveness in refrigeration systems.

There thus remains a need for further improvements in refrigeration systems, including those with water-cooled condensers, which address these and other deficiencies of the known designs.

SUMMARY

According to one embodiment of the present invention, a refrigerator includes water cooling of both a condenser and another portion in the same refrigeration stage as the condenser. In this regard, the refrigerator includes a cabinet having a cabinet interior and a door providing access into the cabinet interior. The refrigerator also includes a first refrigeration stage defining a first fluid circuit for circulating a first refrigerant. The first refrigeration stage has a first compressor, a first condenser, a first expansion device, and a first evaporator in fluid communication with the first fluid circuit. The first evaporator is configured to transfer heat energy removed from the cabinet interior to the first refrigerant. A cooling circuit for circulating water is operatively associated with the first refrigeration stage. The cooling circuit is in thermal fluid communication with the first condenser such that the first condenser is water cooled by having heat energy transferred from the first refrigerant into the water. The refrigerator also includes a heat exchanger in fluid communication with the first fluid circuit and the cooling circuit to further exchange heat energy between the first refrigerant and the water. The heat exchanger is positioned upstream in a flow direction of water in the cooling circuit from the first condenser such that the water removes heat energy from the first refrigerant at the heat exchanger before the water flows to the first condenser and after the first refrigerant flows from the first condenser. The refrigerator of this invention provides higher energy efficiency and quicker pull down from ambient or other warmer temperatures to the desired temperature within the cabinet interior.

In one aspect, the heat exchanger is defined by a liquid line heat exchanger that removes heat energy from the first refrigerant when the first refrigerant is in a liquid phase and flowing from the first condenser. The heat energy is transferred to the water, which is also in a liquid phase in this heat exchanger. The cooling circuit may further include a water valve located between the liquid line heat exchanger and the first condenser, such that water flow into the first condenser can be controlled. In another aspect, the liquid line heat exchanger is positioned in the cooling circuit between a process inlet that introduces water into the cooling circuit and the water valve. The liquid line heat exchanger is also positioned in the first fluid circuit between the first condenser and the first expansion device.

In some embodiments, the first refrigeration stage further includes a condenser fan associated with the first condenser. In such embodiments, the first refrigerant flowing through the first condenser is both water cooled and air cooled. The exchange of heat energy between the first refrigerant and the water at the heat exchanger raises the temperature of the water by about 0.15° C. to 0.20° C. This small temperature rise does not substantially affect the cooling capacity of the water as it flows through the first condenser.

In a further aspect, the refrigerator includes a second refrigeration stage in cascade arrangement with the first refrigeration stage. The second refrigeration stage includes a second fluid circuit that is fluidically isolated from the first fluid circuit for circulating a second refrigerant. The second refrigeration stage also includes a second compressor, a second expansion device, and an evaporator in fluid communication with the second fluid circuit. The first evaporator defines an interstage heat exchanger that also serves as a second condenser in the second refrigeration stage. The interstage heat exchanger is in fluid communication with the first and second fluid circuits to form the cascade arrangement and to exchange heat between the first and second refrigerants. Once again, the heat exchanger may further include a liquid line heat exchanger that removes heat energy from the first refrigerant when the first refrigerant is in a liquid phase and flowing from the first condenser, using heat transfer to the water which is also in a liquid phase.

In embodiments including the first and second refrigeration stages, the first refrigeration stage may further include an intrastage liquid/vapor heat exchanger that transfers heat energy between the first refrigerant in vapor phase traveling in one portion of the first fluid circuit and the first refrigerant in liquid phase traveling in another portion of the first fluid circuit. More specifically, the intrastage heat exchanger is positioned in the first fluid circuit to receive the first refrigerant in vapor phase traveling from the first evaporator to the first compressor, and the intrastage heat exchanger is positioned to receive the first refrigerant in liquid phase traveling from the liquid line heat exchanger to the first expansion device.

In another embodiment of the present invention, a method of refrigerating a cabinet having a cabinet interior is provided. The method includes circulating a first refrigerant through a first fluid circuit in a first refrigeration stage, the first refrigeration stage also including a first compressor, a first condenser, a heat exchanger, a first expansion device, and a first evaporator in fluid communication with the first fluid circuit. The first refrigerant removes heat energy discharged from the cabinet interior at the first evaporator and discharges heat energy at each of the first condenser and the heat exchanger. The method also includes circulating water through a cooling circuit operatively associated with the first refrigeration stage. The cooling circuit is in thermal fluid communication with the first condenser and the heat exchanger. Heat energy that is discharged from the first refrigerant is transferred to the water at each of the first condenser and the heat exchanger. The water flows from the heat exchanger to the first condenser such that the water removes heat energy from the first refrigerant before the water flows to the first condenser, and the first refrigerant flows in an opposite direction from the first condenser to the heat exchanger.

The method includes additional features in some embodiments. For example, the transfer of heat energy between the water and the first refrigerant at the heat exchanger may be done with both fluids in a liquid state. The flow of water may be controlled between the liquid line heat exchanger and the first condenser using a water valve. As set forth above, some embodiments of the method include circulating a second refrigerant through a second fluid circuit of a second refrigeration stage in cascade arrangement with the first refrigeration stage. The second refrigeration stage and the first refrigeration stage are linked for heat transfer at an interstage heat exchanger defining the first evaporator, in such embodiments.

These and other objects and advantages of the invention will become more apparent during the following detailed description taken in conjunction with the drawings herein.

BRIEF DESCRIPTION OF THE DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION

Figure 1:
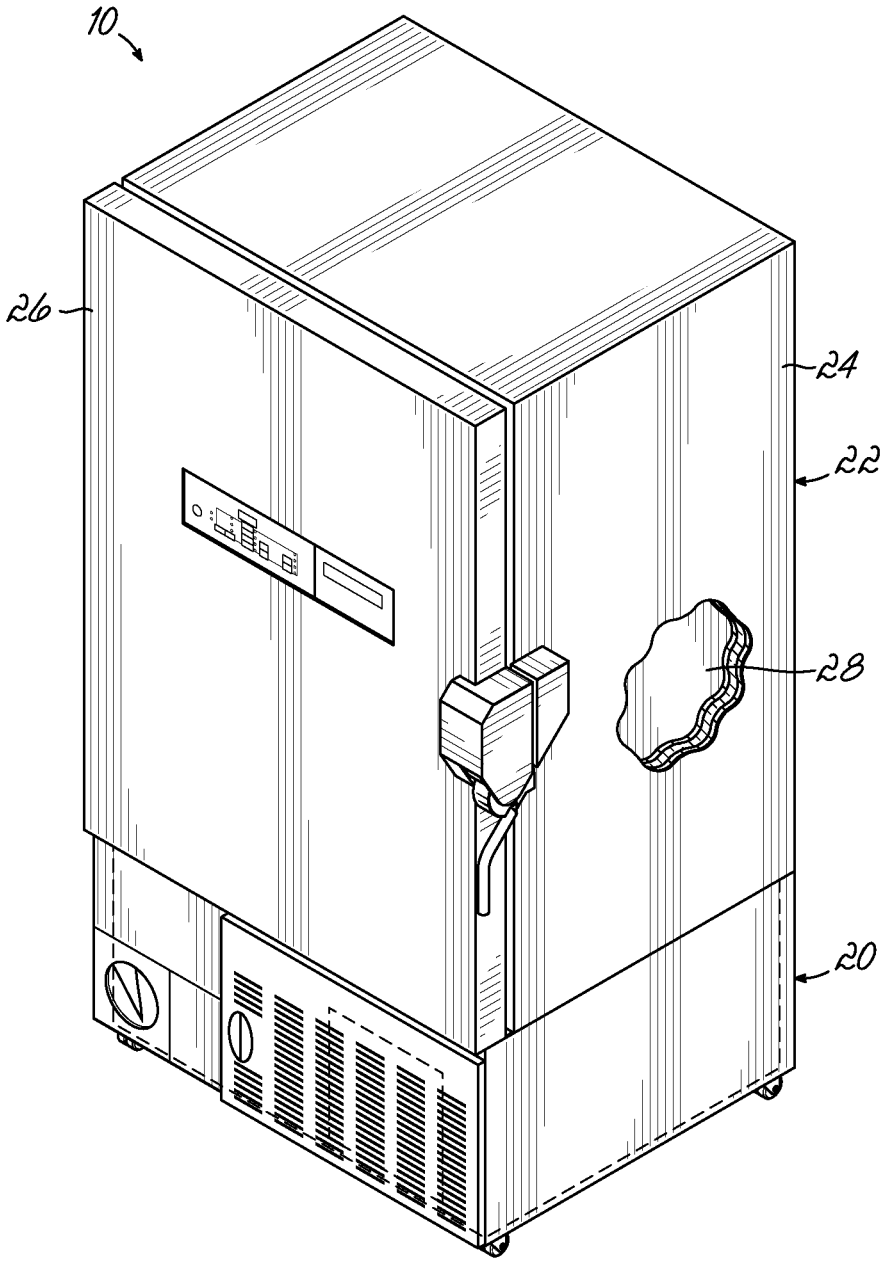
FIG. 1 is a perspective view of a refrigerator including a refrigeration system that uses water cooling, in accordance with one embodiment of the invention.

With reference to the figures, and more specifically to FIGS. 1 through 5, exemplary high performance laboratory refrigerators 10 according to several embodiments of the present invention are illustrated. Although the terms "high performance laboratory refrigerator" and "refrigerator" are used throughout the specification, it will be understood that the invention encompasses any type of cooling device, including any type of refrigerator or freezer. The refrigerator 10 of the present invention includes a refrigeration system 12 having a water-cooled condenser 14 and a liquid line heat exchanger 16 for additional cooling with the water, at a position upstream in the direction of flow of water from the cooling that occurs at the condenser 14. The use of water cooling at these two portions of the refrigeration system 12 improves the energy efficiency of the refrigerator 10, while also significantly improving temperature responsiveness (e.g., reducing an amount of time necessary to "pull down" the temperature of a cooled space in the refrigerator 10 to a desired set point temperature). Accordingly, the refrigerator 10 of the embodiments described in detail below, and the methods of use thereof, provide several technical effects and advantages over conventional refrigerators and refrigeration system designs.

FIG. 1 shows a first embodiment of a refrigerator 10 in accordance with the present invention. In this embodiment, as clarified in the description of FIGS. 2 through 4 below, the refrigerator 10 is an ultra-low temperature freezer ("ULT") including a refrigeration system 12 with cascaded refrigeration stages that enable cooling to desired set point temperatures of about −80° C. or even lower. However, it will be understood a similar structural arrangement may also be used with single stage and other types of refrigeration systems consistent with this invention. The refrigerator 10 of FIG. 1 includes a deck 20 that supports a cabinet 22 for storing items that require cooling to temperatures of about −80° C. or lower, for example. The cabinet 22, in turn, includes a cabinet housing 24 and a door 26 providing access into an interior 28 of the cabinet 22. The deck 20 supports one or more components that jointly define the two-stage cascade refrigeration system 12 (FIG. 2) that thermally interacts with cabinet 22 to cool the interior 28 thereof.

Figure 2:
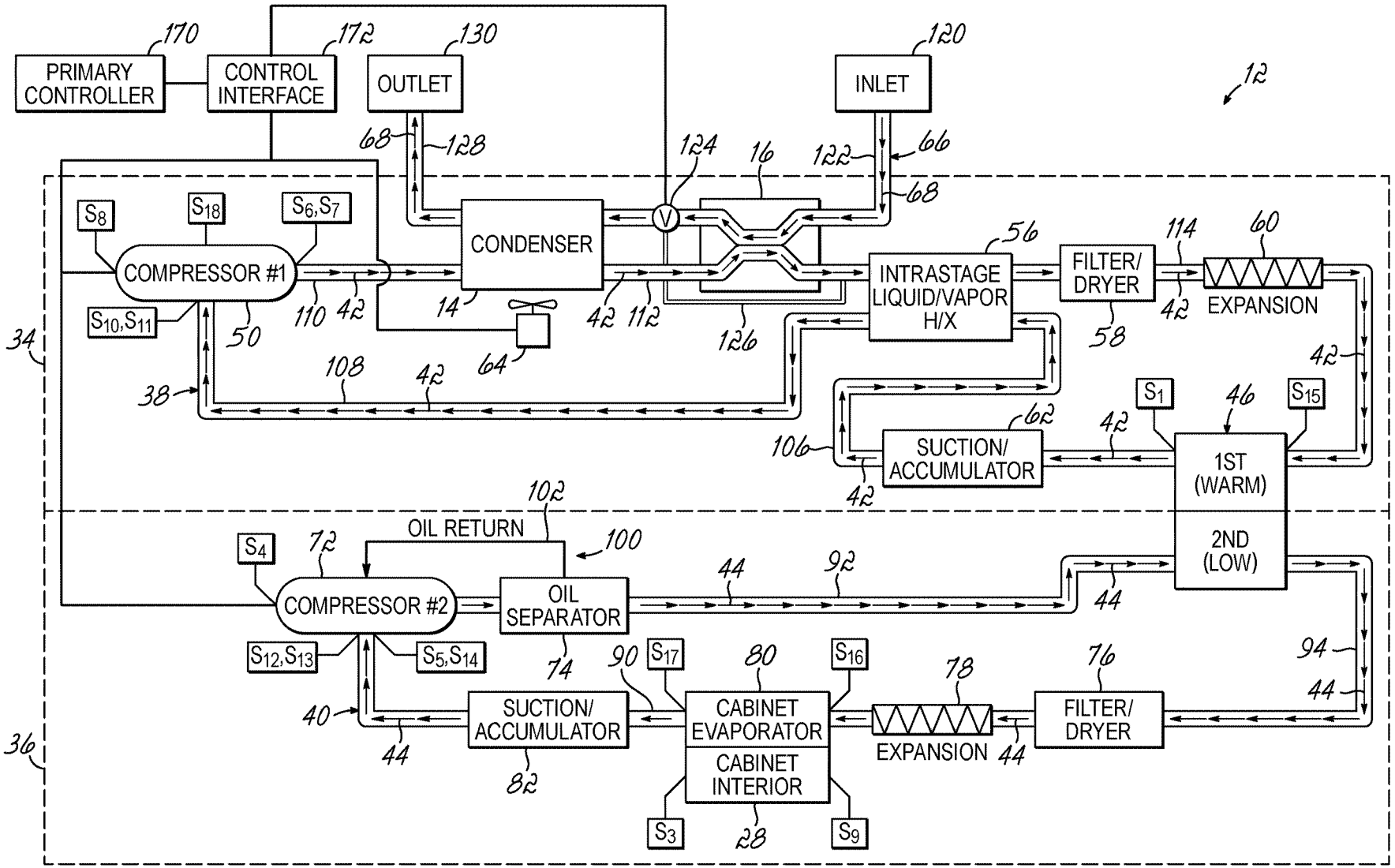
FIG. 2 is a schematic representation of a first embodiment of the refrigeration system for cooling a cabinet interior of the refrigerator of FIG. 1, the refrigeration system including multiple refrigeration stages in cascade arrangement.

Turning to FIG. 2, a schematic representation of the refrigeration system 12 is illustrated. The refrigeration system 12 is made up of a first refrigeration stage 34 and a second refrigeration stage 36 respectively defining first and second fluid circuits 38, 40 for circulating a first refrigerant 42 and a second refrigerant 44. The first refrigeration stage 34 transfers heat energy from the first refrigerant 42 to the surrounding environment, while the second refrigerant 44 of the second refrigeration stage 36 receives heat energy from the cabinet interior 28 and discharges heat energy to the first refrigerant 42. To this end, in the cascade arrangement shown in this embodiment, heat energy is transferred from the second refrigerant 44 to the first refrigerant 42 through an interstage heat exchanger 46 that is in fluid communication with the first and second stages 34, 36 of the refrigeration system 12.

The first refrigeration stage 34 includes, in sequence, a first compressor 50, the water-cooled condenser 14 (also referred to as a first condenser), the liquid line heat exchanger 16, an intrastage liquid/vapor heat exchanger 56, a filter/dryer unit 58, a first expansion device 60, the interstage heat exchanger 46 serving as a first evaporator, and a suction/accumulator device 62. A fan 64 is also provided proximate the water-cooled condenser 14 to direct ambient air across the condenser 14 and thereby facilitate additional transfer of heat energy from the first refrigerant 42 to the surrounding environment. As will be described in further detail below, the water-cooled condenser 14 and the liquid line heat exchanger 16 are in thermal fluid communication with a cooling circuit 66 configured to circulate water 68 and configured to receive heat energy discharged from the first refrigerant 42 for transfer to the surrounding environment. The first compressor 50 in this embodiment may include a variable speed compressor or a fixed speed compressor. Likewise, the first expansion device 60 includes a capillary tube, an electronic expansion valve, or the like, as will be readily understood in the refrigeration field.

The second refrigeration stage 36 includes, in sequence, a second compressor 72, an oil separator 74, the interstage heat exchanger 46 serving as a second condenser, a filter/dryer unit 76, a second expansion device 78, a "second" evaporator 80 (the first evaporator being the interstage heat exchanger 46), and a suction/accumulator device 82. The evaporator 80 is in thermal communication with the cabinet interior 28 such that heat is transferred from the interior 28 to the second refrigerant 44 flowing through the evaporator 80, thereby cooling the interior 28 to a desired temperature set point. The second compressor 72 in this embodiment may include a variable speed compressor or a fixed speed compressor. Likewise, the second expansion device 78 includes a capillary tube, an electronic expansion valve, or the like, as will be readily understood in the refrigeration field.

In operation, and as shown in FIG. 2 schematically, the second refrigerant 44 receives heat from the cabinet interior 28 through the evaporator 80 and flows from the evaporator 80 to the second compressor 72 through a conduit 90. The suction/accumulator device 82 of the second refrigeration stage 36 is in fluid communication with this conduit 90 to pass the second refrigerant 44 in gaseous phase to the second compressor 72, while accumulating excessive amounts of the same in liquid phase and feeding it to the second compressor 72 at a controlled rate. From the second compressor 72, the compressed second refrigerant 44 flows through a conduit 92 and into the interstage heat exchanger 46 thermally communicating the first and second refrigeration stages 34, 36 with one another. The oil separator 74 is located at this conduit 92, as described further below.

The second refrigerant 44 enters the interstage heat exchanger 46 in gaseous phase and transfers heat to the first refrigerant 42, thereby causing the second refrigerant 44 to condense. In this regard, the flow of the first refrigerant 42 may, for example, be counter-flow relative to the second refrigerant 44 within the interstage heat exchanger 46, to maximize the rate of heat transfer. In one specific, non-limiting example, the interstage heat exchanger 46 is in the form of a brazed plate heat exchanger, vertically oriented within the deck 20 and designed to maximize the amount of turbulent flow of the first and second refrigerants 42, 44 within the interstage heat exchanger 46, which in turn maximizes the heat transfer from the condensing second refrigerant 44 to the evaporating first refrigerant 42. Other types or configurations of heat exchangers are possible as well.

The second refrigerant 44 then exits the interstage heat exchanger 46, in liquid phase, and flows through a conduit 94 to the filter/dryer unit 76, then through the second expansion device 78, and then back to the evaporator 80. The second expansion device 78 de-pressurizes the second refrigerant 44 and causes the second refrigerant 44 to be at a coldest state/temperature when flowing to the evaporator 80, where heat energy from the cabinet interior 80 is to be received and the second refrigerant 44 vaporized. The second refrigerant 44 is then back at the beginning of the second fluid circuit 40 and the process repeats to continue removing heat energy from the cabinet interior 28 and discharging heat energy to the first refrigerant 42.

The second refrigerant 44 is typically at very low (subzero Celsius) temperatures during the various stages of the operation cycle described above. Accordingly, the second refrigeration stage 36 of this embodiment also includes an oil loop 100 for lubricating the second compressor 72. Specifically, the oil loop 100 includes the oil separator 74, which is in fluid communication with conduit 92 as noted above, and an oil return line 102 directing oil back into second compressor 72 from the oil separator 74. The lubrication of the second compressor 72 can therefore be assured despite the operation parameters and conditions at the second refrigeration stage 36.

Moving now to the operation at the first refrigeration stage 34, the first refrigerant 42 enters an inlet of the interstage heat exchanger 46 in liquid phase, receives heat energy from the second refrigerant 44 flowing through the interstage heat exchanger 46, exits the interstage heat exchanger 46 in gaseous phase through an outlet thereof, and flows through a pair of conduits 106, 108 towards the first compressor 50. The suction/accumulator device 62 is positioned in conduit 106 to pass the first refrigerant 42 in gaseous phase towards the first compressor 50, while accumulating excessive amounts of the same in liquid phase and feeding it towards the first compressor 50 at a controlled rate. The first refrigerant 42 also passes through the intrastage liquid/vapor heat exchanger 56, which is located between the conduits 106, 108 before flowing to the first compressor 50. Within the intrastage liquid/vapor heat exchanger 56, heat transfer occurs between the first refrigerant 42 in mostly vapor phase traveling within conduits 106, 108 and the first refrigerant 42 in liquid phase at another portion of the first refrigeration stage 34 described below. For example, the first refrigerant 42 traveling towards the first expansion device 60 and the interstage heat exchanger 46 may be further cooled by this heat exchange. Such additional cooling prior to entry into the first expansion device 60 significantly improves efficiency and performance of the refrigeration system 12, as set forth in further detail below.

From the first compressor 50, the compressed first refrigerant 42 flows through a conduit 110 and into the water-cooled condenser 14. The first refrigerant 42 in the water-cooled condenser 14 transfers heat to the water 68 flowing through the condenser 14, thereby condensing the first refrigerant 42 into liquid phase before flowing through another conduit 112 leading to the intrastage liquid/vapor heat exchanger 56 described above. While flowing in this conduit 112, the liquid phase first refrigerant 42 passes through the liquid line heat exchanger 16, at which further heat discharge occurs to the water 68 flowing in the cooling circuit 66, and then the first refrigerant 42 flows to the intrastage liquid/vapor heat exchanger 56. Following the heat transfer at the intrastage liquid/vapor heat exchanger 56, the first refrigerant 42 flows through a conduit 114 that passes through the filter/dryer unit 58, the first expansion device 60 where the first refrigerant 42 undergoes a pressure drop, and then to the interstage heat exchanger 46, entering the same in liquid phase. The first refrigerant 42 is then back at the beginning of the first fluid circuit 38 and the process repeats to continue removing heat energy from the second refrigeration stage 36 and discharging heat energy to the external environment via the water 68 in the cooling circuit 66.

Figure 3:
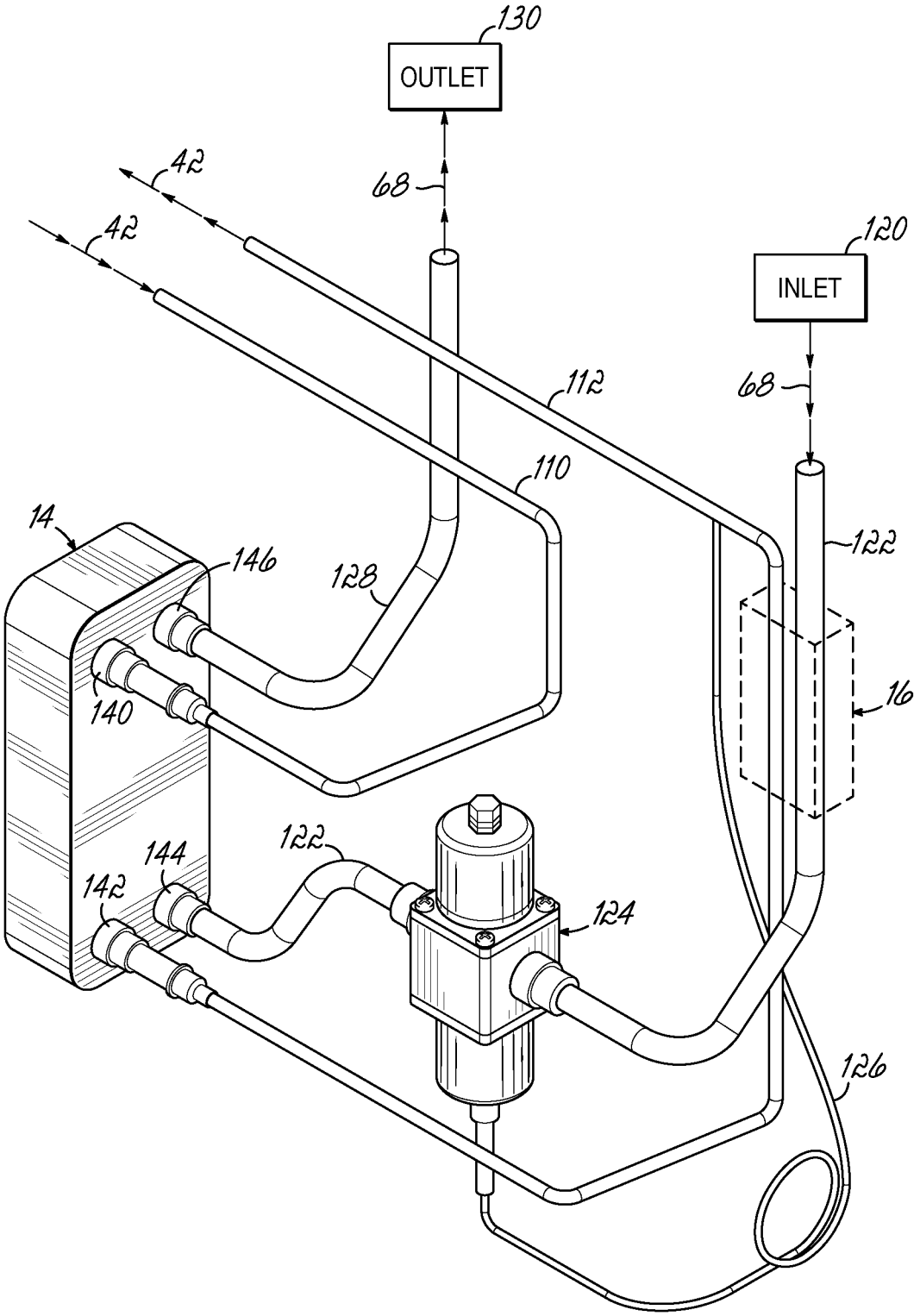
FIG. 3 is a detailed perspective view showing one layout of the water circuit and water cooled elements included in the refrigeration system of FIG. 2.

FIGS. 2 and 3 illustrate further details of the cooling circuit 66 and the equipment that the cooling circuit 66 includes and/or interacts with. To this end, the cooling circuit 66 includes a process inlet 120 that introduces water 68 at a cold temperature into a conduit 122 extending to the water-cooled condenser 14. The liquid line heat exchanger 16 is positioned along this conduit 122, as well as a water valve 124 that is configured to control the flow of water 68 towards the condenser 14. As shown in FIG. 3, the liquid line heat exchanger 16 is defined by a coupling together (by brazing, welding, or the like) of a length of the conduit 122 in the cooling circuit 66 and the conduit 112 carrying the first refrigerant 42 in the first fluid circuit 38. The length of the coupling between the conduits 112, 122 may be about 4 inches in length, in one example, although other lengths may also be used in further embodiments. According to exemplary test results of the refrigeration system 12, the water 68 flowing through the liquid line heat exchanger 16 is raised in temperature a small amount, such as by about 0.15° C. to 0.2° C., as a result of the heat exchange with the first refrigerant 42. By comparison, the first refrigerant 42 was sub-cooled in these tests by about 1.25° C. following flow through the approximate 4-inch length of the liquid line heat exchanger 16. This difference in the temperature change caused by the heat transfer occurring at the liquid line heat exchanger 16 is in part because there is a greater volumetric flow of water 68 in a larger conduit 122 as compared to the smaller conduit 112 carrying the first refrigerant 42. This sub-cooling of the first refrigerant 42 leads to several advantages in operating the refrigerator 10, including a reduced pull-down time for cooling the cabinet interior 28.

The water 68 then flows to the water valve 124, as shown in FIGS. 2 and 3. The water valve 124 of this embodiment is a pressure-actuated valve that may communicate with the first fluid circuit 38 via a capillary tube 126 extending from the conduit 112. The capillary tube 126 transmits the pressure of the first refrigerant 42 flowing through the conduit 112 and the liquid line heat exchanger 16 without significantly impacting flow through the first fluid circuit 38. To this end, once the first refrigerant 42 reaches a pressure of about 120 PSI within the conduit 112, the water valve 124 is automatically actuated in response to open flow of water 68 through conduit 122 and into the water-cooled condenser 14. One example of such a water valve 124 is the WVFX and WVS water valves commercially available from Danfoss A/S, of Nordborgvej, Denmark. By controlling the water valve 124 based on a threshold pressure of the first refrigerant 42, the flow of water 68 can be provided only when cooling is necessary at the condenser 14, e.g., when the first refrigerant 42 is circulating through the first refrigeration stage 34. Alternative designs of water valves may be used in other embodiments consistent with the invention, including those with positive control from a controller rather than pressure-based control.

From the conduit 122 and water valve 124, the water 68 then flows into the water-cooled condenser 14. The water-cooled condenser 14 of this embodiment is formed as a brazed plate heat exchanger with a plurality of stacked plates coupled together to form counter flow paths for the first refrigerant 42 and for the water 68, as described in further detail below with reference to FIG. 4. The water 68 receives heat energy discharged from the first refrigerant 42 so that the first refrigerant 42 undergoes a phase transition to liquid phase, and such that the water 68 increases in temperature to carry the heat energy away to the external/ambient environment. As briefly described above, a condenser fan 64 may also be provided in some embodiments to help receive heat energy from the first refrigerant 42 at the condenser 14. After flowing through the water-cooled condenser 14, the water 68 flows through another conduit 128 of the cooling circuit 66 that extends to a process outlet 130, where the warmed-up water is discharged from the cooling circuit 66. New cold water 68 is then supplied back to the process inlet 120 to continue the flow and cooling process at the cooling circuit 66. It will be understood that while water 68 is described as the coolant used in the cooling circuit 66 of this embodiment, a water-glycol mixture or some other water-based mixture may also be used in other embodiments consistent with the scope of the invention.

Figure 4:
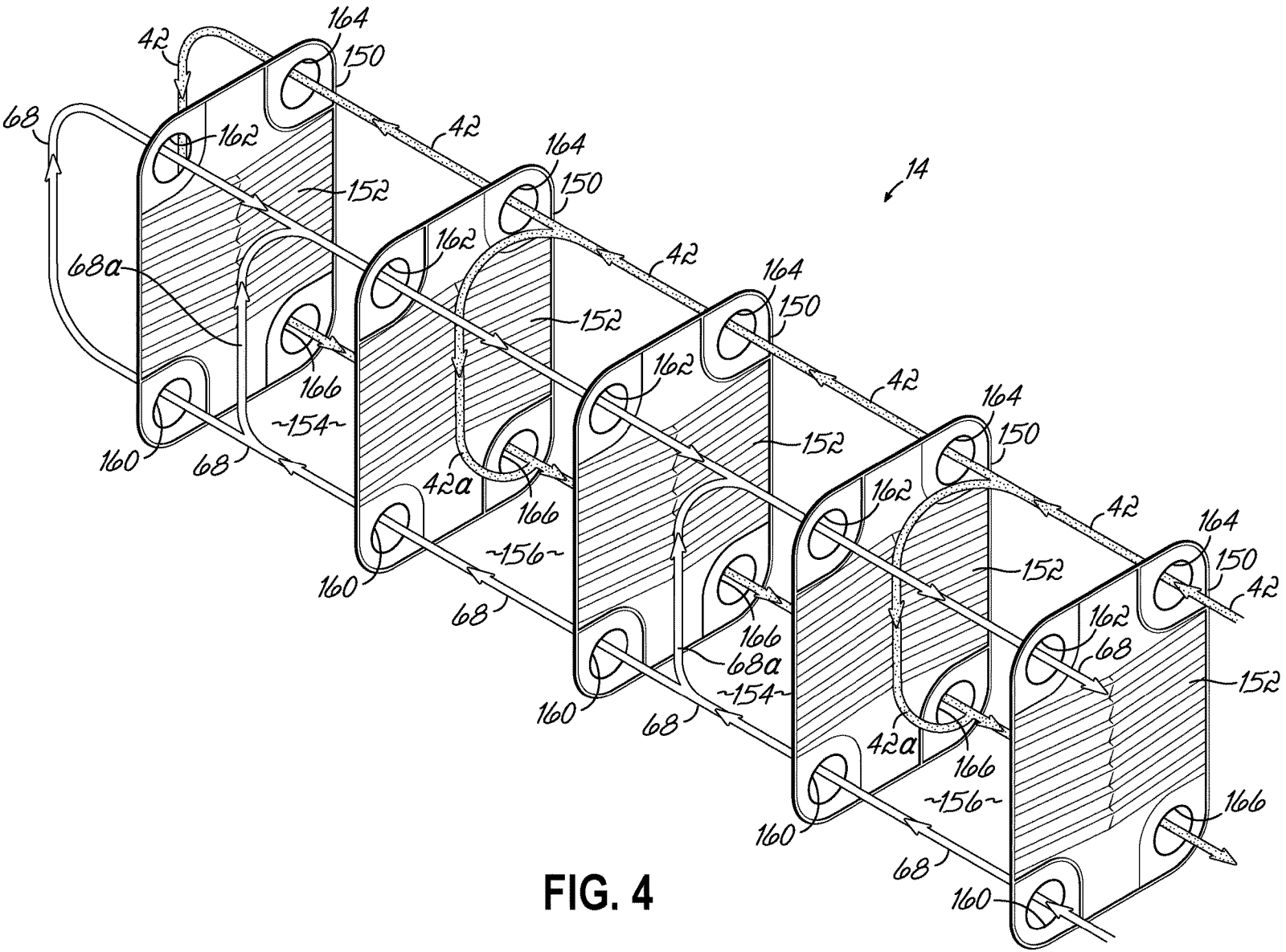
FIG. 4 is an exploded perspective view of the water-cooled condenser shown in FIGS. 2 and 3.

With reference to FIG. 4, further details of the internal structure and flow paths within the water-cooled condenser 14 of this embodiment are shown. Only a partial portion of the internal structure of the water-cooled condenser 14 is shown in this Figure. In this exemplary embodiment, the water-cooled condenser 14 is oriented generally vertically (see FIG. 3) such that the first refrigerant 42 flows in a generally downward direction while the water 68 flows in a generally upward direction. More specifically, the first refrigerant 42 enters the water-cooled condenser 14 at a first inlet 140 proximate an upper portion thereof and exits the water-cooled condenser 14 at a first outlet 142 proximate a lower portion thereof. Similarly, the water 68 enters the water-cooled condenser 14 proximate the lower portion thereof, specifically at a second inlet 144, and exits the water-cooled condenser 14 proximate the upper portion thereof, specifically at a second outlet 146. As discussed above, the first refrigerant 42 condenses from a gaseous phase to a liquid phase in the water-cooled condenser 14, as a result of heat transfer from the first refrigerant 42 into the water 68, which increases in temperature within the water-cooled condenser 14.

The water-cooled condenser 14 illustrated in the figures is arranged such that a plurality of generally parallel streams 42*a* of the first refrigerant 42 and a plurality of generally parallel streams 68*a* of the water 68 are directed through the water-cooled condenser 14, in counter-flow fashion, to permit the exchange of heat between the first refrigerant 42 and the water 68, as illustrated schematically in FIG. 4. To this end, the exemplary water-cooled condenser 14 is in the form of a split-flow, brazed plate heat exchanger that includes a plurality of stacked flat plates 150 that are spaced from one another and each having on one or both of its planar surfaces a series of channels 152. For example, the water-cooled condenser 14 of this embodiment may include twelve flat plates 150 enclosed between front and back panels (not shown in FIG. 4), although it will be understood that more or fewer plates 150 may be used in other embodiments, and only some of these flat plates 150 are shown in the illustration of FIG. 4.

Each of the respective volumes between adjacent flat plates 150 defines a chamber 154, 156, within which either the first refrigerant 42 or the water 68 flows. Further, the chambers 154, 156 are arranged in alternating fashion such that two adjacent chambers 154, 156 receive the flow of water 68 and first refrigerant 42, respectively. Under normal conditions, it is expected that each chamber 154 will have liquid water 68 flowing therethrough and which heats up via heat transfer from the first refrigerant 42 in adjacent chambers 156 as the water 68 moves upwardly. Under normal conditions, it is expected that each chamber 156 will have gaseous first refrigerant 42 adjacent to its top which flows therethrough and condenses via heat transfer to the water 68 in adjacent chambers 154 as the first refrigerant 42 moves downwardly.

In one aspect of the exemplary water-cooled condenser 14, the shapes of the channels 152 on the flat plates 150 are chosen to facilitate the generation of turbulent flow within the water-cooled condenser 14, which in turn maximizes the level of heat transfer between the first refrigerant 42 and the water 68. For example, and without limitation, the channels 152 may be chevron-shaped or be formed as pleats of corrugated plates. Other shapes and structures for the channels 152 defining the chambers 154, 156 may be used in other embodiments.

As used herein, the term "split-flow" brazed plate heat exchanger refers to a heat exchanger that splits at least one of the streams from a single stream into a plurality of streams that are eventually rejoined into a single fluid stream. To this end, the water 68 flowing into the second inlet 144 is transferred along an aligned series of lower portholes 160 formed in each of the flat plates 150, with the lower portholes 160 in fluid communication with the chambers 154 but not the chambers 156, and the water 68 then rejoins to flow through an aligned series of upper portholes 162 formed in each of the flat plates 150 and in fluid communication with the chambers 154. The upper portholes 162 communicate with the second outlet 146. Likewise, the first refrigerant 42 flowing into the first inlet 140 then flows through another aligned series of upper portholes 164 in fluid communication with each of the chambers 156 (but not the chambers 154 for water 68), and then the first refrigerant 42 flows rejoin in another aligned series of lower portholes 166 leading to the first outlet 142.

While the exemplary water-cooled condenser 14 is arranged to receive therethrough respective pluralities of streams 42*a*, 68*a* of the first refrigerant 42 and the water 68, it is contemplated that, alternatively, a different type of water-cooled condenser 14 may be arranged in other embodiments consistent with the scope of the invention. For example, alternative water-cooled condensers 14 may take the form of tube-and-shell heat exchangers, fin-plate heat exchangers, or other types of heat exchangers arranged to permit the flow of the heat transferring fluids in a plurality of streams in a counter-flow, cross-flow, or parallel-flow arrangement. The use of any of these alternative types of heat exchangers is deemed to fall within the scope of the present disclosure. Further, the exemplary water-cooled condenser 14 illustrated in FIG. 4 permits the flow of multiple streams of the first refrigerant 42 that are generally parallel to one another, and the flow of multiple streams of the water 68 that are also parallel to one another. This type of flow within the water-cooled condenser 14 is intended to be exemplary rather than limiting. The description of the particular structure and operation of the brazed plate heat exchanger will also be understood to equally apply to the interstage heat exchanger 46, in embodiments where that element is also formed by a brazed plate heat exchanger.

Returning to FIG. 2, the refrigeration system 12 also includes an exemplary controller 170 that is operatively coupled to each of the first and second compressors 50, 72 for independently controlling each of the compressors 50, 72. While this embodiment illustrates a single controller 170, those of ordinary skill in the art will readily appreciate that refrigeration system 12 may have any other number of controllers instead. More specifically, the controller 170 may include a processor, a memory, and an input/output (I/O) control interface 172. The processor may include one or more devices configured to manipulate signals and/or data based on operational instructions that are stored in memory. Memory may include a single memory device or a plurality of memory devices configured to store information in the form of data. The memory may store computer program code embodied as one or more computer software applications comprising instructions executed by the processor, such as a controller application designed to operate the refrigeration system 12 in various states. One or more data structures may also reside in memory, and may be used by the processor to store and process data.

The control interface 172 operatively couples the processor to other components of the refrigeration system 12, such as the compressors 50, 72, the condenser fan 64, and the water valve 124 (optional). The control interface 172 may include signal processing circuits that condition incoming and outgoing signals so that the signals are compatible with both the processor and the components with which the processor communicates. To this end, the control interface 172 may include analog-to-digital (A/D) and/or digital-to-analog (D/A) converters, voltage level and/or frequency shifting circuits, optical isolation and/or driver circuits, data busses, and/or any other analog or digital circuitry that enables the processor to communicate with the other components of the refrigeration system 12.

The control interface 172 may also enable interaction with the controller 170 by a user. Such interaction may include, for example, choosing from among different modes of operation of the refrigeration system 12. For example, and without limitation, different modes of operation may be associated with different maximum normally accepted noise levels of the system 12 during steady-state operation, such as noise standards issued by OSHA, for example, different temperature ranges for each of the refrigeration stages 34, 36, and/or different temperature settings for the cabinet interior 28. More specifically, a refrigerator designed for operation in an enclosed laboratory may be set by the user not to exceed a particular noise level (which could result in one or both compressors being limited to a particular percentage of maximum speed and, if a variable speed fan is used, its speed as well). The same refrigerator operated in a large area could be set or reset to allow for a higher percentage of maximum speed, if the noise level is of no particular concern to the user. Other additional or alternative preferred operating characteristics of the ULT in this embodiment may, however, be used to define operating parameters of the refrigeration system 12.

A plurality of sensors $S_1$ through $S_{18}$ may be provided at various locations in the refrigeration system 12, with each operatively coupled to the controller 170 to sense different properties of the refrigerator 10 and the refrigeration system 12. Such properties may include door openings, interior temperatures, refrigerant and/or water temperatures, operating speeds of compressors and fans, and the like. These sensors are configured to generate respective signals to the controller 170 that are indicative of the sensed property or condition, such that the controller 170 may, in turn, generate respective commands impacting operation of the refrigeration system 12.

As described briefly above, the use of the water-cooled condenser 14 and multiple cooling or sub-cooling steps in the first refrigeration stage 34 provides several benefits and advantages for the refrigerator 10. In this regard, by having the first refrigerant 42 cooled by water 68 in the condenser 14, then subcooled by water 68 in the liquid line heat exchanger 16 (and optionally also cooled by the intrastage liquid/vapor heat exchanger 56 after that), several performance enhancements are achieved according to test results of the Applicant. For example, the multiple steps of cooling allow for a higher relative capacity index to be achieved, which means that the first compressor 50 can be operated or provided with less maximum capacity than what would be required without the multiple steps of cooling. In another aspect, the multiple cooling steps reduce the total recovery time to return the temperature in the cabinet interior 28 to a desired temperature following a door opening or some other temperature spike event. One example from test results was a reduction in pull down time to the desired temperature by about 60 to 110 minutes as compared to conventional designs with no additional cooling/sub-cooling heat exchangers (for reference, the pull-down time typically ranges from 250 minutes for cooling from a mid-temperature condition to 800 minutes for cooling from am ambient temperature condition). In still another aspect, the total energy efficiency of the refrigerator 10 is improved. Thus, the provision of the liquid line heat exchanger 16 in combination with the water-cooled condenser 14 for multiple water cooling steps (and optionally also the intrastage liquid/vapor heat exchanger 56) further improves efficiency and performance of the refrigerator 10 without necessitating a significant amount of additional equipment or space for the refrigeration system 12.

Figure 5:
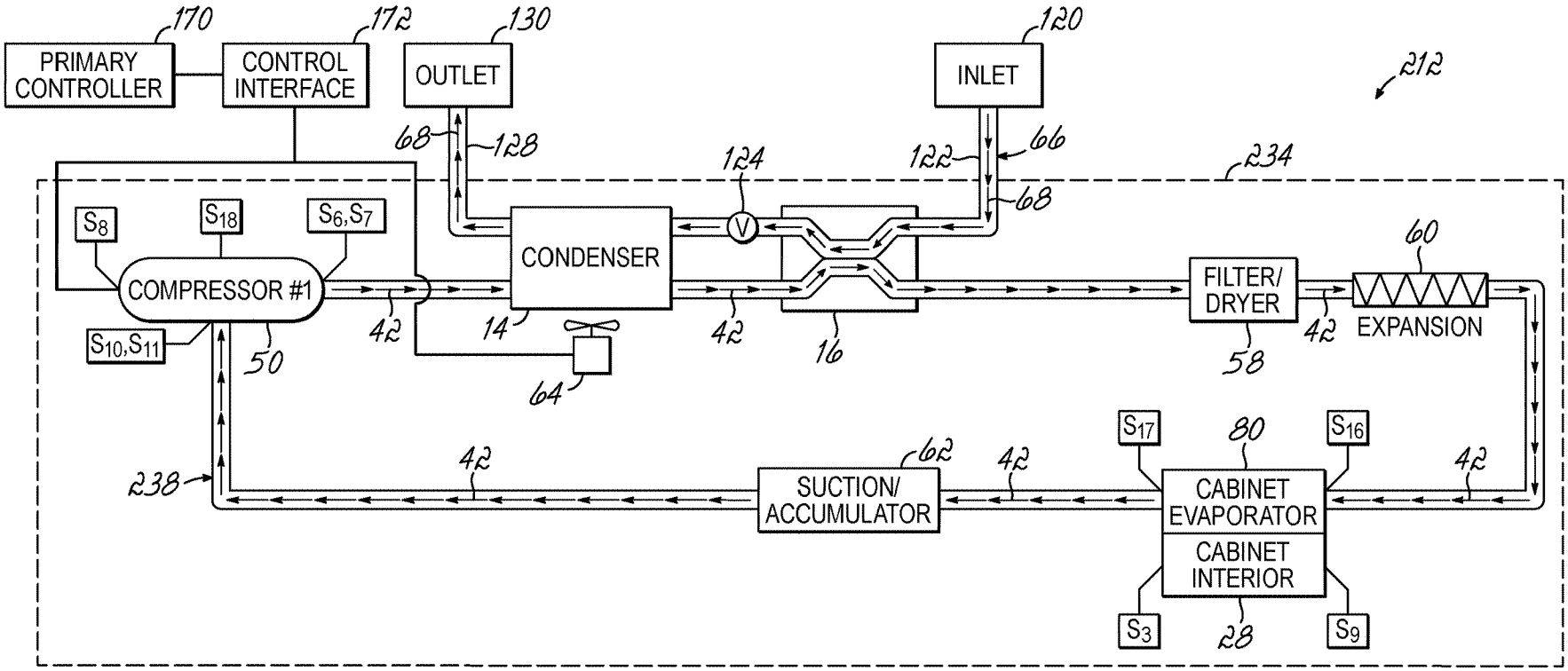
FIG. 5 is a schematic representation of a second embodiment of the refrigeration system for cooling the cabinet interior of the refrigerator of FIG. 1.

It will be appreciated that many of these same benefits may also be achieved by a refrigerator that includes only a single refrigeration stage (e.g., not a ULT), and such an alternative embodiment of the present invention is shown at the refrigeration system 212 of FIG. 5. The refrigeration system 212 contains many of the same elements as the first refrigeration stage 34 and the cooling circuit 66 of the previous embodiment, and as such, these elements have been labeled with similar or identical reference numbers without further description necessary herein. To this end, the refrigeration system 212 of this embodiment includes a first fluid circuit 238 defining a refrigeration stage 234 for circulating a first refrigerant 42 and a cooling circuit 66 for circulating water 68. The refrigeration stage 234 includes the following elements in sequence in the first fluid circuit 238: a first compressor 50, a water-cooled condenser 14 (which may include a condenser fan 64 for air cooling as well), a liquid line heat exchanger 16, a filter/dryer unit 58, a first expansion device 60 such as a capillary tube or expansion valve, a cabinet evaporator 80, and a suction/accumulator device 62. The first refrigerant 42 circulates through these elements to receive heat energy from the cabinet interior 28 and then discharge the heat energy to the water 68 at both the water-cooled condenser 14 and the liquid line heat exchanger 16. The cooling circuit 66 is arranged in an identical fashion as that described above for the first embodiment, and the water 68 therefore provides multiple steps of cooling/sub-cooling for the first refrigerant 42 before the first refrigerant 42 moves to the first expansion device 60 and to the cabinet evaporator 80. This arrangement improves the energy efficiency and reduces pull down times for the refrigerator, for the reasons explained in detail above. Accordingly, the improvements of the design of the present invention are applicable in various types of refrigeration systems 12, 212 having any number of circuits/stages.

While the present invention has been illustrated by a description of exemplary embodiments and while these embodiments have been described in considerable detail, it is not the intention of the applicant to restrict or in any way limit the scope of the appended claims to such detail. Additional advantages and modifications will readily appear to those skilled in the art. The invention in its broader aspects is therefore not limited to the specific details, representative apparatus and method, and illustrative example shown and described. Accordingly, departures may be made from such details without departing from the scope of Applicant's general inventive concept.

What is claimed is:

1. A refrigerator, comprising:

a cabinet having a cabinet interior and a door providing access into the cabinet interior;

a first refrigeration stage defining a first fluid circuit for circulating a first refrigerant, the first refrigeration stage having a first compressor, a first condenser, a first expansion device, and a first evaporator in fluid communication with the first fluid circuit, the first evaporator configured to transfer heat energy removed from the cabinet interior to the first refrigerant;

a cooling circuit for circulating water and operatively associated with the first refrigeration stage, the cooling circuit being in thermal fluid communication with the first condenser such that the first condenser is water cooled by having heat energy transferred from the first refrigerant into the water; and a heat exchanger in fluid communication with the first fluid circuit and the cooling circuit to further exchange heat energy between the first refrigerant and the water, wherein the heat exchanger is positioned upstream in a flow direction of water in the cooling circuit from the first condenser such that the water removes heat energy from the first refrigerant before the water flows to the first condenser and after the first refrigerant flows from the first condenser, wherein the first condenser and the heat exchanger are directly connected by a conduit in the first refrigeration stage so that the first refrigerant flowing out of the first condenser is directed immediately into the heat exchanger and is then further cooled below a temperature of the first refrigerant at an exit of the first condenser.

2. The refrigerator of claim 1, wherein the heat exchanger is a liquid line heat exchanger that removes heat energy from the first refrigerant when the first refrigerant is in a liquid phase and flowing from the first condenser, with the heat energy transferred to the water, which is also in a liquid phase, wherein the liquid line heat exchanger is defined by a direct coupling by brazing and/or welding of a conduit in the first fluid circuit carrying the first refrigerant with a conduit in the cooling circuit carrying the water, the direct coupling of the conduits being over a length.

3. The refrigerator of claim 2, wherein the cooling circuit further includes a water valve positioned between the liquid line heat exchanger and the first condenser, the water valve configured to control flow of water into the first condenser.

4. The refrigerator of claim 3, wherein the liquid line heat exchanger is located in the cooling circuit between a process inlet that introduces water into the cooling circuit and the water valve, and the liquid line heat exchanger is located in the first fluid circuit between the first condenser and the first expansion device.

5. The refrigerator of claim 1, wherein the first refrigeration stage further includes a condenser fan associated with the first condenser, such that the first refrigerant flowing through the first condenser is both water cooled and air cooled.

6. The refrigerator of claim 1, wherein exchange of heat energy between the first refrigerant and the water at the heat exchanger raises a temperature of the water by about 0.15° C. to 0.2° C.

7. The refrigerator of claim 1, further comprising:

a second refrigeration stage in cascade arrangement with the first refrigeration stage, the second refrigeration stage defining a second fluid circuit that is fluidically isolated from the first fluid circuit for circulating a second refrigerant, and the second refrigeration stage including a second compressor, a second expansion device, and an evaporator in fluid communication with the second fluid circuit, wherein the first evaporator defines an interstage heat exchanger that also serves as a second condenser in the second refrigeration stage, the interstage heat exchanger being in fluid communication with the first and second fluid circuits to exchange heat between the first and second refrigerants.

8. The refrigerator of claim 7, wherein the heat exchanger is a liquid line heat exchanger that removes heat energy from the first refrigerant when the first refrigerant is in a liquid phase and flowing from the first condenser, with the heat energy transferred to the water, which is also in a liquid phase.

9. The refrigerator of claim 8, wherein the first refrigeration stage further comprises:

an intrastage liquid/vapor heat exchanger that transfers heat energy between (i) the first refrigerant in vapor phase traveling in one portion of the first fluid circuit and (ii) the first refrigerant in liquid phase traveling in another portion of the first fluid circuit.

10. The refrigerator of claim 9, wherein the intrastage liquid/vapor heat exchanger is positioned in the first fluid circuit so as to receive the first refrigerant in vapor phase traveling from the first evaporator to the first compressor, and the intrastage liquid/vapor heat exchanger is positioned so as to receive the first refrigerant in liquid phase traveling from the liquid line heat exchanger to the first expansion device.

* * * * *